US006713431B2

(12) United States Patent
Yasuda et al.

(10) Patent No.: US 6,713,431 B2
(45) Date of Patent: Mar. 30, 2004

(54) METALLIC LUSTER TONE THERMOCHROMIC LAMINATE MEMBER

(75) Inventors: Michiyuki Yasuda, Nagoya (JP); Yutaka Shibahashi, Nagoya (JP)

(73) Assignee: The Pilot Ink Co., Ltd., Aichi (JP)

( * ) Notice: Subject to any disclaimer, the term of this patent is extended or adjusted under 35 U.S.C. 154(b) by 80 days.

(21) Appl. No.: 10/179,393

(22) Filed: Jun. 26, 2002

(65) Prior Publication Data

US 2003/0008774 A1 Jan. 9, 2003

(30) Foreign Application Priority Data

Jun. 29, 2001 (JP) ..... P. 2001-199451
Jul. 12, 2001 (JP) ..... P. 2001-211496

(51) Int. Cl.[7] ..... B41M 5/40
(52) U.S. Cl. ..... 503/207; 503/201; 503/226
(58) Field of Search ..... 503/201, 207, 503/226

(56) References Cited

U.S. PATENT DOCUMENTS 5,352,649 A 10/1994 Shibahashi et al.

*Primary Examiner*—B. Hamilton Hess
(74) *Attorney, Agent, or Firm*—Sughrue Mion, PLLC

(57) ABSTRACT

A metallic luster tone thermochromic laminate member 1, which comprises a laminate of a metallic luster layer 2 containing a metallic luster pigment prepared by coating the surface of a synthetic mica or thin section aluminum oxide with a metal oxide and a reversible thermochromic layer 3 containing a thermochromic composition comprising an electron-donating color-forming organic compound, an electron-accepting compound and an organic compound medium in which color reactions of both compounds take place reversibly. The metallic luster tone thermochromic laminate member can visualize metallic luster colors having glittering high brightness and distinct changes in color by its reversible thermochromic layer so that it can be used in versatile applications and developments.

6 Claims, 2 Drawing Sheets

METALLIC LUSTER TONE THERMOCHROMIC LAMINATE MEMBER

FIELD OF THE INVENTION

This invention relates to metallic luster tone thermochromic laminate members. More particularly, it relates to a metallic luster tone thermochromic laminate member constituted in such a manner that it shows gold, silver, metallic color or the like metallic luster having high brightness caused by temperature changes and also that changes in color can be visualized.

BACKGROUND OF THE INVENTION

With respect to a metallic luster tone thermochromic laminate member, a proposal has been disclosed (U.S. Pat. No. 5,352,649).

This proposal is a laminate member in which a metallic luster layer containing a metallic luster pigment prepared by coating the surface of a synthetic mica with titanium oxide is arranged on a reversible thermochromic layer, which can visualize changes in color from the metallic luster tone by temperature changes and can show specific color changes in comparison with the color changes of conventional thermochromic materials, so that it has applicability not only to the heat sensitive paint field but also to decorations, toys and the like various fields.

SUMMARY OF THE INVENTION

By further studying visual effects of this type of metallic luster tone thermochromic laminate member, the present inventors aim at providing a metallic luster tone thermochromic laminate member, which has a metallic luster rich in brightness showing glittering aspect while it can also produce more distinct color changes by discoloration of a reversible thermochromic layer.

The present invention relates to a metallic luster tone thermochromic laminate member, which comprises a laminate of (1) a metallic luster layer containing a metallic luster pigment prepared by coating the surface of a synthetic mica with a metal oxide and (2) a reversible thermochromic layer containing a thermochromic composition comprising an electron-donating color-forming organic compound, an electron-accepting compound and an organic compound medium in which color reactions of both compounds take place reversibly. The present invention also relates to (1) a metallic luster tone thermochromic laminate member, which comprises a laminate of a metallic luster layer containing a metallic luster pigment prepared by coating the surface of thin section aluminum oxide with a metal oxide and (2) a reversible thermochromic layer containing a thermochromic composition comprising an electron-donating color-forming organic compound, an electron-accepting compound and an organic compound medium in which color reactions of both compounds take place reversibly.

Figure 1:
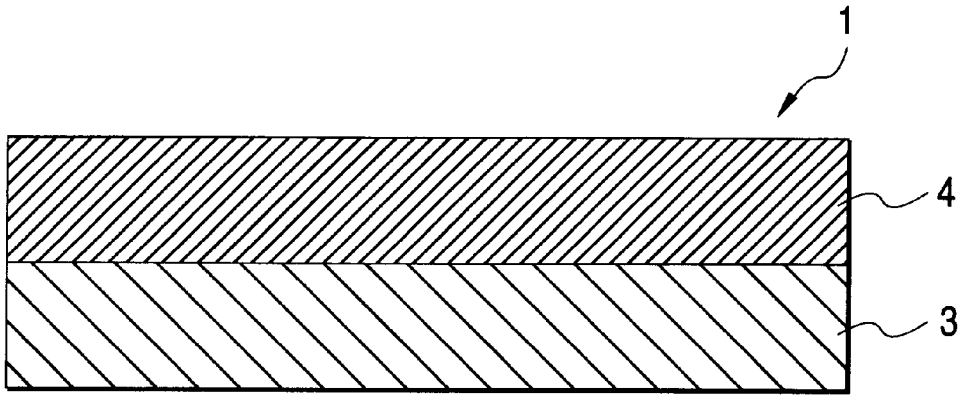
FIG. 1 is a longitudinal sectional illustration of an example of the metallic luster tone thermochromic laminate member of the invention.
Figure 2:
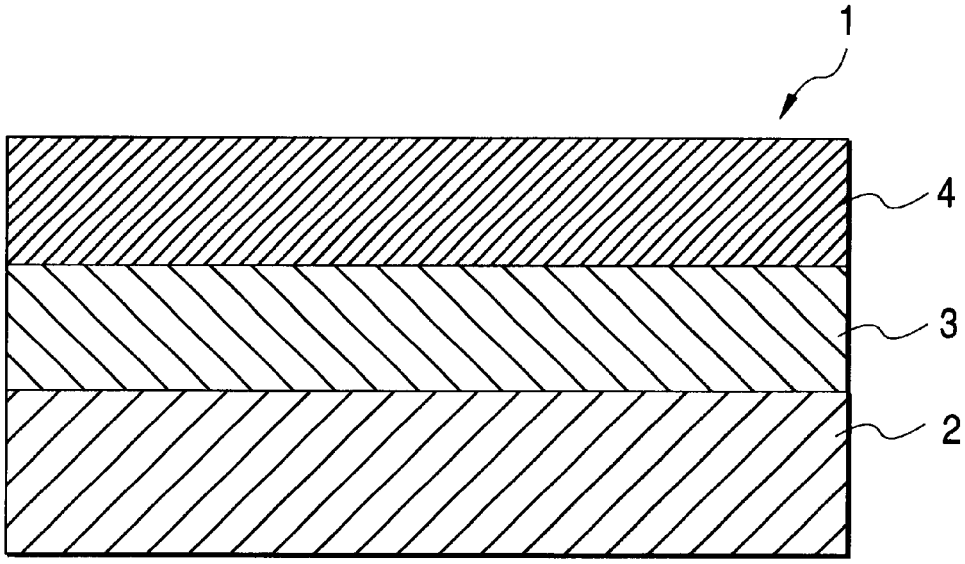
FIG. 2 is a longitudinal sectional illustration of another example of the metallic luster tone thermochromic laminate member of the invention.
Figure 3:
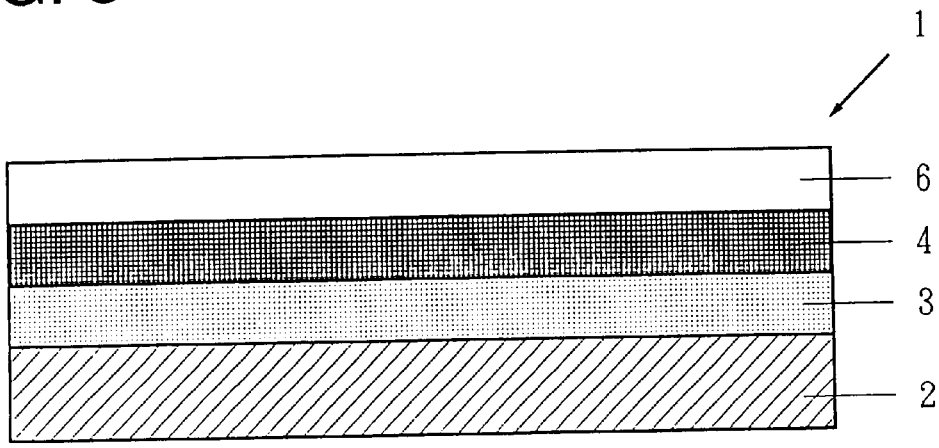
FIG. 3 is a longitudinal sectional illustration of still another example of the metallic luster tone thermochromic laminate member of the invention.
Figure 4:
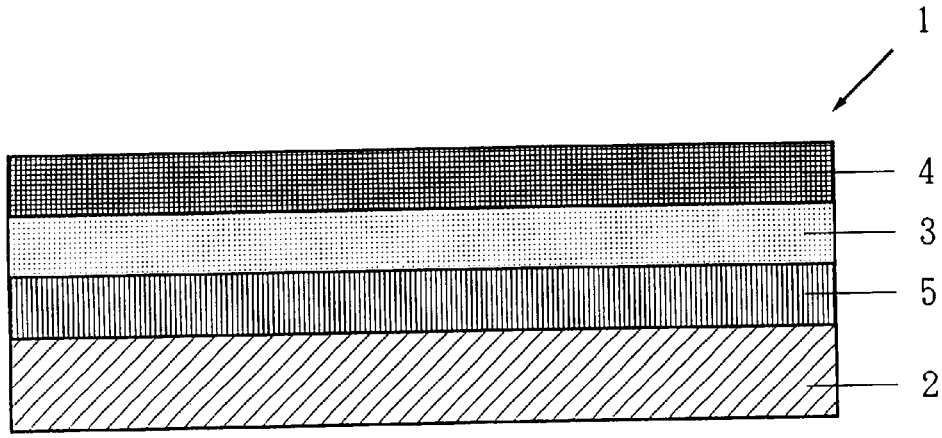
FIG. 4 is a longitudinal sectional illustration of a further example of the metallic luster tone thermochromic laminate member of the invention.

In the figures, the numbers has the following meanings, respectively.

| | |
|---|---|
| 1 | Metallic luster tone thermochromic laminate member |
| 2 | Substrate |
| 3 | Metallic luster layer |
| 4 | Reversible thermochromic layer |
| 5 | Non-discoloration layer |
| 6 | Topcoat layer |

DETAILED DESCRIPTION OF THE INVENTION

Since the metallic luster pigment to be used in the metallic luster tone laminate member previously proposed by the applicant is a pigment prepared by coating the surface of natural mica with titanium oxide, it shows gold, silver or metallic color metallic luster based on the coating ratio of titanium oxide. Accordingly, it is possible to show a glittering aspect and at the same time to visualize different aspects by color changes of the reversible thermochromic layer caused by temperature changes.

As a result of further examination on the aforementioned laminate member which shows color changes by the metallic luster and temperature changes, the inventors have found that a metallic luster tone thermochromic laminate member whose changes in aspect by color changes of the reversible thermochromic layer are more distinctive can be obtained by the use of a metallic luster pigment prepared by coating the surface of a synthetic mica or thin section aluminum oxide with a metal oxide.

Among the metallic luster pigments to be used in the invention, a pigment which uses a synthetic mica as the core substance is excellent in transparency because of the small content of impurities and iron and the like metal ions having a coloring tendency, and the metallic luster is obtained by coating with a metal oxide typified by titanium oxide, so that it shows gold, silver or metallic color metallic luster based on the coating ratio of the aforementioned metal oxide.

Accordingly, since a metallic luster pigment prepared by coating a synthetic mica with a metal oxide is also rich in brightness and excellent in transparency, color tone of the reversible thermochromic layer can be clearly visualized.

As the synthetic mica to be used as the core substance of the aforementioned metallic luster pigment, a synthetic mica represented by the following general formula (1) is suitable, and $KMg_3(AlSi_3O_{10})F_2$ can be cited as an example.

$$X_{1/3-1}Y_{2-3}Z_4O_{10}F_2 \quad (1)$$

(In the formula, X represents $Na^+$, $Li^+$, $K^+$, $Ca^{2+}$, $Sr^{2+}$ or $Ba^{2+}$, Y represents one or two or more members selected from $Mg^{2+}$, $Li^+$, $Ni^{2+}$, $Co^{2+}$, $Zn^{2+}$, $Mn^{2+}$, $Al^{3+}$, $Cr^{3+}$ and $Ti^{3+}$, and Z represents one or two or more members selected from $Al^{3+}$, $Si^{4+}$, $Ge^{4+}$ and $B^{3+}$.)

In this connection, the shape of the aforementioned synthetic mica is not particularly limited, and examples thereof include flat shapes and flaky shapes.

Examples of the metal oxide with which the surface of the aforementioned synthetic mica is coated include oxides of metals such as titanium, zirconium, chromium, vanadium and iron, but it is preferred to use a metal oxide comprising titanium oxide as the main component.

The aforementioned metallic luster pigment has an average thickness of from 0.1 to 5 μm and an average particle diameter of from 2 to 1,000 μm, preferably from 2 to 500 μm, more preferably from 2 to 200 μm. The use of a metallic luster pigment having the just described thickness and average particle diameter renders possible uniform brightness of the metallic luster layer and generation of distinct color changes by discoloration of the reversible thermochromic layer. The aforementioned average particle diameter means the average particle diameter which is determined by laser diffractometry and is the particle diameter corresponding to the 50% point in a cumulative median diameter distribution on a volume basis.

Illustrative examples of the metallic luster pigments comprising the aforementioned synthetic mica whose surface is coated with a metal oxide include "Ultimica" (trade name, mfd. by Nihon Kokenkogyo K.K.) product numbers: SB-100 (5 to 30 μm; silver), SD-100 (10 to 60 μm; silver), SE-100 (15 to 100 μm; silver), SF-100 (44 to 150 μm; silver), SH-100 (150 to 600 μm; silver), YB-100 (5 to 30 μm; gold), YD-100 (10 to 60 μm; gold), YE-100 (15 to 100 μm; gold), YF-100 (44 to 150 μm; gold), RB-100 (5 to 300 μm; metallic red), RD-100 (10 to 60 μm; metallic red), RE-100 (15 to 100 μm; metallic red), RF-100 (44 to 150 μm; metallic red), RBB-100 (5 to 30 μm; metallic purple), RBD-100 (10 to 60 μm; metallic purple), RBE-100 (15 to 100 μm; metallic purple), RBF-100 (44 to 150 μm; metallic purple), VB-100 (5 to 30 μm; metallic violet), VD-100 (10 to 60 μm; metallic violet), VE-100 (15 to 100 μm; metallic violet), VF-100 (44 to 150 μm; metallic violet), BB-100 (5 to 30 μm; metallic blue), BD-100 (10 to 60 μm; metallic blue), BE-100 (15 to 100 μm; metallic blue), BF-100 (44 to 150 μm; metallic blue), GB-100 (5 to 30 μm; metallic green), GD-100 (10 to 60 μm; metallic green), GE-100 (15 to 100 μm; metallic green) and GF-100 (44 to 150 μm; metallic green).

Average particle diameter and color tone are shown in parentheses.

Also, a pigment which uses thin section aluminum oxide as the core substance has smaller content of impurities in comparison with the generally used natural mica, and the metallic luster is obtained by coating with a metal oxide typified by titanium oxide, so that it shows gold, silver or metallic color metallic luster based on the coating ratio of the aforementioned metal oxide.

Accordingly, since a metallic luster pigment prepared by coating aluminum oxide with a metal oxide is also rich in brightness and excellent in transparency, color tone of the reversible thermochromic layer can be clearly visualized.

Examples of the metal oxide with which the surface of the aforementioned aluminum oxide is coated include oxides of metals such as titanium, zirconium, chromium, vanadium and iron, but it is preferred to use a metal oxide comprising titanium oxide as the main component.

The aforementioned metallic luster pigment has an average thickness of from 0.1 to 5 μm and an average particle diameter of from 2 to 200 μm.

The use of a metallic luster pigment having the just described thickness and average particle diameter renders possible uniform brightness of the metallic luster layer and generation of distinct color changes by discoloration of the reversible thermochromic layer.

The aforementioned average particle diameter means the average particle diameter which is determined by laser diffractometry and is the particle diameter corresponding to the 50% point in a cumulative median diameter distribution on a volume basis.

As an illustrative example of the aforementioned metallic luster pigment prepared by coating the surface of thin section aluminum oxide with a metal oxide, "Xirallic" as a trade name manufactured by Merck, product number: T50-10 (10 to 30 μm; silver) can be cited.

Average particle diameter and color tone are shown in parentheses.

In addition, a metallic luster pigment obtained by coating flat glass pieces with titanium oxide can also be used jointly with the aforementioned metallic luster pigments.

Examples of such a metallic luster pigment include those which are manufactured by Nippon Sheet Glass Co., Ltd. and sold under the trade name of "Metashine" as product numbers: RCFSX-5450TS(6041) [average thickness 5±2 μm, average particle size 450±145 μm, gold], RCFSX-5200TS(6042) [average thickness 5±2 μm, average particle size 200±70 μm, silver], RCFSX-5140TS(6043) [average thickness 5±2 μm, average particle size 140±45 μm, silver], RCFSX-5080TS(6044) [average thickness 5±2 μm, average particle size 80±30 μm, silver], RCFSX-2080TS(6046) [average thickness 2±1 μm, average particle size 80±30 μm, silver], RCFSX-K120TS(6043) [average thickness 20±5 μm, average particle size 120±20 μm, silver], RCFSX-5090RC(8052) [average thickness 5±2 μm, average particle size 90±30 μm, gold], RCFSX-5090RC(8053) [average thickness 5±2 μm, average particle size 90±30 μm, metallic green], RCFSX-5090RC(8069) [average thickness 5±2 μm, average particle size 90±30 μm, metallic blue], RCFSX-5090RC(8070) [average thickness 5±2 μm, average particle size 90±30 μm, metallic purple], RCFSX-5090RC(8071) [average thickness 5±2 μm, average particle size 90±30 μm, metallic red] and the like.

The laminate member of the invention is comprises by laminating the metallic lust layer and the reversible thermochromic layer, and the laminate constitution is not particularly limited but it is desirable to arrange the metallic lust layer on the upper layer, namely the side to be visualized and the reversible thermochromic layer is arranged on the lower layer.

By this constitution, the metallic luster can be expressed sufficiently and changes in the aspect accompanied by color changes of the reversible thermochromic layer arranged on the lower layer can be visualized clearly.

In addition, it also has an effect to improve light resistance of the reversible thermochromic layer by the aforementioned metallic luster layer.

The metallic luster layer can be formed on a substrate, by using an ink or paint prepared by dispersing the aforementioned metallic luster pigment in a vehicle, and by known techniques such as screen printing, offset printing, gravure printing, coater printing, tampon printing, transfer printing and the like printing techniques, and coating techniques such as brush coating, spray coating, electrostatic coating, electrodeposition, curtain coating, roller coating, dip coating and the like.

In addition, a molding formed by blending the aforementioned metallic luster pigment in a thermoplastic resin or thermosetting resin may be used as the metallic luster layer.

When the aforementioned metallic luster pigments in the metallic luster layer have a flat shape, each pigment is apt to take planar orientation so that more superior brightness can be obtained.

In this connection, even when overlapping portions of the aforementioned metallic luster pigments are present, the metallic luster is not spoiled depending on the transparency of pigments and distinct metallic lust color can be visualized.

The aforementioned reversibly thermochromic layer contains a reversible thermochromic composition in the layer, and as the composition, a composition containing three components, namely an electron-donating color-forming organic compound, an electron-accepting compound and an organic compound medium reversibly generating the color reaction, is suitably used. Illustratively, the reversible thermochromic compositions described in U.S. Pat. No. 4,028,118 and U.S. Pat. No. 4,732,810 can be exemplified.

They change colors before and after a specified temperature (discoloring point) as the border, and of both states before and after the change, only a specified one state can be present at the ordinary temperature range. That is, the other state is a type which changes color showing small maximum hysteresis error (ΔH) regarding so-called temperature-color density by temperature changes, in which the state is maintained while the heat or cold required for its expression is applied, but returned to a state of the ordinary temperature range when said application of heat or cold is cancelled.

Also useful is a temperature sensitively discoloring, color memorizing thermochromic composition which changes color by showing large hysteresis characteristic, described in U.S. Pat. No. 4,720,301 proposed by the applicant, namely a thermochromic composition which is a discoloring material of a type that changes color via greatly different pathway of a curve prepared by plotting changes in the coloring density by temperature changes, between a case in which temperature is increased from a lower temperature side than the discoloring temperature range and a contrary case in which it is decreased from a higher temperature side than the discoloring temperature, and which has a characteristic in that it can memorize and keep a state changed at a temperature of a low temperature side discoloring point or less or a high temperature side discoloring point or more within the ordinary temperature range between the low temperature side discoloring point and high temperature side discoloring point.

In addition, a reversible thermochromic composition which uses an alkoxyphenol compound as the electron-accepting compound and shows coloring by temperature rising can also be used.

The aforementioned reversible thermochromic composition is effective when applied as such, but it is desirable to use after its inclusion in microcapsules. This is because the reversible thermochromic composition is kept at the same composition and can exert the same action and effect under various use conditions.

By its inclusion in microcapsules, a chemically and physically stable microencapsulated pigment can be constructed, and a particle diameter of within the range of from 0.1 to 100 μm, preferably from 3 to 30 μm, satisfies its practical use.

In this connection, examples of the microencapsulation include generally known interfacial polymerization, in situ polymerization, in-liquid curing coating, phase separation from an aqueous solution, phase separation from an organic solvent, melt dispersion cooling, air-suspension coating, spray drying and the like, and optionally selected in response to the use. In addition, the microcapsules can also be subjected to practical use after adding durability by arranging a secondary resin coat on their surfaces in response to the object or modifying their surface characteristics.

A reversible thermochromic layer can be formed by the aforementioned conventionally known methods, by using an ink or paint prepared by dispersing the aforementioned reversible thermochromic composition in vehicles.

In addition, a molding formed by blending the aforementioned reversible thermochromic composition-included microencapsulated pigment in a thermoplastic resin or thermosetting resin may be used as the reversible thermochromic layer.

By adding an appropriate amount of a non-thermochromic colored dyestuff or pigment to the aforementioned reversible thermochromic layer, color changes of the thermochromic layer can be constituted colorfully.

When at least one of the aforementioned metallic luster layer and reversible thermochromic layer is a molding, a substrate is not particularly required, but a substrate becomes necessary when both are liquid compositions of ink, paint and the like.

The just described substrate is selected from papers, synthetic papers, metals, porcelains and pottery, stones, woods, glasses, resins, cloth and the like materials, and its shape is not particularly limited.

In this connection, in the case of the use of an opaque substrate, the reversible thermochromic layer and metallic luster layer are arranged on the visualizing side of the substrate upper layer. In this case, a laminate member rich in brightness is obtained when the metallic luster layer is arranged on the reversible thermochromic layer as described in the foregoing.

When the substrate shows transparency, it can be it can be arrange on the upper layer of the reversible thermochromic layer and metallic luster layer or can be interposed between the reversible thermochromic layer and metallic luster layer.

As the just described transparent substrate, glasses and resins can be exemplified, and a resin molding or resin film is preferably used.

In this connection, the aforementioned transparency may be translucency, colored transparency or colored translucency, in addition to colorless transparency.

It is desirable to improve durability and water resistance of the aforementioned laminate member by arranging a topcoat layer on the uppermost layer thereof.

In addition, a light stabilizer layer can be optionally arranged on the uppermost layer of the aforementioned laminate member or between respective layers. Illustratively, the just described light stabilizer layer is a layer to which a light stabilizer selected from ultraviolet ray absorbents, antioxidants, age resistors, singlet oxygen quenchers, superoxide anion quenchers, ozone decolorizers, visible light absorbents and infrared absorbents is adhered in a dispersed state, and can be formed in accordance with the aforementioned reversible thermochromic layer or metallic layer preparation method.

In this connection, it is more desirable to arrange the light stabilizer layer on the aforementioned uppermost layer, because light resistance of the reversible thermochromic layer can also be provided, in addition to the durability and water resistance.

The metallic luster tone thermochromic laminate member of the invention is formed by laminating two layers, namely a metallic luster layer and a reversible thermochromic layer, and a substrate is not required when at least one of these layers has the thickness and strength as a substrate.

Also, when the materials for forming respective layers are paint and the like liquid forms, they are arranged by coating them in order on an optional substrate.

In addition, when each layer is formed by a molding, a laminate member is obtained by adhering respective layers.

Next, examples are shown illustratively. All parts in the examples are parts by weight.

INVENTIVE EXAMPLE 1 (CF. FIG. 1)

A doll (reversibly thermochromic layer 3) was formed by blending an ABS resin with a reversibly thermochromic microencapsulated pigment having an average particle diameter of 8 μm, obtained by encapsulating a thermochromic composition consisting of a compatible mixture of 3 parts of 2-anilino-3-methyl-dibutylaminofluoran, 6 parts of 4,4'-(2-methyl-propylidene)bisphenol and 50 parts of neopentyl stearate by an epoxy resin/amine curing agent interfacial polymerization, and with a fluorescent orange pigment, and a metallic luster layer 4 having a thickness of about 40 μm consisting of a purple metallic luster pigment prepared by coating the surface of a synthetic mica with titanium oxide [mfd. by Nihon Kokenkogyo K.K., trade name: RBP-100, average particle diameter 10 to 60 μm] and an acrylic ester resin was arranged on the surface on the doll, thereby obtaining a metallic luster tone thermochromic laminate member 1.

At 15° C. or less, the above laminate member 1 visualizes a metallic purple metallic luster color having glittering high brightness. Also, at 32° C. or more, the metallic luster color having high brightness is not visualized due to change of the reversibly thermochromic layer into a fluorescent orange color, but a distinct fluorescent orange color generated by the reversibly thermochromic layer is visualized.

INVENTIVE EXAMPLE 2 (CF. FIG. 2)

A reversibly thermochromic layer 3 having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, was laminated on a white ABS plate used as substrate 2, on which was then arranged a metallic luster layer 4 having a thickness of about 40 μm consisting of a gold metallic luster pigment prepared by coating the surface of a synthetic mica with titanium oxide [mfd. by Nihon Kokenkogyo K.K., trade name: YD-100, average particle diameter 10 to 60 μm] and an acrylic ester resin, thereby obtaining a metallic luster tone thermochromic laminate member 1.

At 15° C. or less, the above laminate member 1 visualizes a gold metallic luster color having glittering high brightness, because the reversibly thermochromic layer 3 develops color and thereby reflects reflected light of a wavelength of from 550 to 600 nm as a part of incident light and absorbs transmitted light of other wavelengths. Also, since the reversibly thermochromic layer decolors and reflects transmitted light at 32° C. or more, it reflects all wavelengths of the incident light, so that the metallic luster color having high brightness is not visualized but a distinct white color due to the substrate is visualized.

INVENTIVE EXAMPLE 3

A reversibly thermochromic layer having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, was laminated on a white vinyl chloride resin molding, on which was then arranged a metallic luster layer having a thickness of about 40 μm consisting of a blue metallic luster pigment prepared by coating the surface of a synthetic mica with titanium oxide [mfd. by Nihon Kokenkogyo K.K., trade name: BE-100, average particle diameter 15 to 100 μm] and an acrylic ester resin, thereby obtaining a metallic luster tone thermochromic laminate member.

At 15° C. or less, the above laminate member visualizes a blue metallic luster color having glittering high brightness, because the reversibly thermochromic layer develops color and thereby reflects light as a part of visual light of incident light and absorbs light of other wavelengths. Also, since the reversibly thermochromic layer decolors and reflects transmitted light at 32° C. or more, it reflects all wavelengths of the incident light, so that the metallic luster color having high brightness is not visualized but a distinct white color due to the molding is visualized.

INVENTIVE EXAMPLE 4 (CF. FIG. 3)

A reversibly thermochromic layer 3 having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, was laminated on a yellow ABS plate used as substrate 2, on which was then arranged a metallic luster layer 4 having a thickness of about 40 μm consisting of a silver metallic luster pigment prepared by coating the surface of a synthetic mica with titanium oxide [mfd. by Nihon Kokenkogyo K.K., trade name: SE-100, average particle diameter 15 to 100 μm] and an acrylic ester resin, and then a topcoat layer 6 having a thickness of about 40 μm consisting of 4 parts of a benzotriazole ultraviolet ray absorber and 100 parts of an acrylic ester resin was arranged on the upper layer thereof, thereby obtaining a metallic luster tone thermochromic laminate member 1.

At 15° C. or less, the above laminate member 1 visualizes a silver metallic luster color having glittering high brightness, because the reversibly thermochromic layer develops color and thereby reflects light as a part of incident visible light and absorbs light of other wavelengths. Also, since the reversibly thermochromic layer decolors and reflects transmitted light at 32° C. or more, it reflects all wavelengths of the incident light, so that the metallic luster color having high brightness is not visualized but a distinct yellow color due to the ABS plate is visualized.

INVENTIVE EXAMPLE 5 (CF. FIG. 4)

On a dinosaur-shaped transparent polystyrene molding used as a substrate 2 were arranged a non-discoloration layer 5 having a thickness of 40 μm consisting of 10 parts of a titanium oxide white pigment and 50 parts of an acrylic ester resin, next a reversibly thermochromic layer 3 having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, and then a metallic luster layer 4 having a thickness of about 40 μm consisting of a green metallic luster pigment prepared by coating the surface of a synthetic mica with titanium oxide [mfd. by Nihon Kokenkogyo K.K., trade name: GE-100, average particle diameter 15 to 100 μm] and an acrylic ester resin, thereby obtaining a metallic luster tone thermochromic laminate member 1.

At 15° C. or less, the above laminate member 1 visualizes a metallic green metallic luster color having glittering high brightness, because the reversibly thermochromic layer develops color and thereby reflects reflected light of a wavelength of from 500 to 540 nm as a part of incident light and absorbs transmitted light of other wavelengths. Also, since the reversibly thermochromic layer decolors and reflects transmitted light at 32° C. or more, it reflects all wavelengths of the incident light, so that the metallic luster color having high brightness is not visualized but a distinct white color due to the non-discoloration layer 5 is visualized.

INVENTIVE EXAMPLE 6

A reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4"-(2-methyl-propylidene) bisphenol and 50 parts of neopentyl stearate by an epoxy resin/amine curing agent interfacial polymerization, a fluorescent yellow pigment and a polystyrene resin were blended and formed into a plate shape reversible thermochromic layer, on which was then arranged a metallic luster layer having a thickness of about 40 μm consisting of a silver metallic luster pigment prepared by coating the surface of thin section aluminum oxide particles with titanium oxide [mfd. by Merck Japan, trade name: Xirallic T50-10 Crystal Silver, average particle diameter 10 to 30 μm] and an acrylic ester resin, thereby obtaining a metallic luster tone thermochromic laminate member.

When the above laminate member is observed from its metallic luster layer side, a silver metallic luster color having glittering high brightness is visualized at 15° C. or less, because the reversibly thermochromic layer develops color and thereby reflects light as a part of incident light and absorbs transmitted light of other wavelengths. Also, since the color of the reversibly thermochromic layer changes to a fluorescent yellow at 32° C. or more, the metallic luster color having high brightness is not visualized but a distinct fluorescent yellow color due to the reversibly thermochromic layer is visualized.

INVENTIVE EXAMPLE 7

A reversibly thermochromic layer having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, was laminated on a white ABS plate used as the substrate, on which was then arranged a metallic luster layer having a thickness of about 40 μm consisting of a silver metallic luster pigment prepared by coating the surface of thin section aluminum oxide particles with titanium oxide [mfd. by Merck Japan, trade name: Xirallic T50-10 Crystal Silver, average particle diameter 10 to 30 μm] and an acrylic ester resin, thereby obtaining a metallic luster tone thermochromic laminate member.

At 15° C. or less, the above laminate member visualizes a silver metallic luster color having glittering high brightness, because the reversibly thermochromic layer develops color and thereby reflects a part of incident light and absorbs light of other wavelengths. Also, since the reversibly thermochromic layer decolors and reflects transmitted light at 32° C. or more, it reflects all wavelengths of the incident light, so that the metallic luster color having high brightness is not visualized but a distinct white color due to the substrate is visualized.

INVENTIVE EXAMPLE 8

Preparation of Gold Metallic Luster Pigment

A 20 g portion of thin section aluminum oxide was suspended in 400 ml of desalted water. This was heated to 65° C., and a $TiCl_4$ solution having a concentration of 125 g/l was added thereto at a rate of 0.6 ml/min, while keeping the pH value at 2.5 by adding 10% aqueous solution of sodium hydroxide. Addition of the $TiCl_4$ solution was stopped when development of gold color was obtained.

The pigment obtained in the above manner was separated by filtration, washed with water, dried and then baked at 850° C. to obtain a gold metallic luster pigment.

Production of Metallic Luster Tone Thermochromic Laminate Member

A reversibly thermochromic layer having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, and an acrylic ester resin, was laminated on a white ABS plate, on which was then arranged a metallic luster layer having a thickness of about 40 μm consisting of the gold metallic luster pigment obtained in the above and an acrylic ester resin, thereby obtaining a metallic luster tone thermochromic laminate member.

At 15° C. or less, the above laminate member visualizes a gold metallic luster color having glittering high brightness, because the reversibly thermochromic layer develops color and thereby reflects light as a part of incident light and absorbs light of other wavelengths. Also, since the reversibly thermochromic layer decolors and reflects transmitted light at 32° C. or more, it reflects all wavelengths of the incident light, so that the metallic luster color having high brightness is not visualized but a distinct white color due to the substrate is visualized.

INVENTIVE EXAMPLE 9

A reversibly thermochromic layer having a thickness of about 40 μm consisting of a reversibly thermochromic microencapsulated pigment having an average particle diameter of 8 μm, obtained by encapsulating a thermochromic composition consisting of a compatible mixture of 3 parts of 2-anilino-3-methyl-6-dibutylaminofluoran, 6 parts of 4,4'-(2-methyl-propylidene)bisphenol and 50 parts of neopentyl stearate by an epoxy resin/amine curing agent interfacial polymerization, a fluorescent orange pigment and an acrylic ester resin, was laminated on a white ABS plate used as the substrate, next, a metallic luster layer 4 having a thickness of about 40 μm consisting of a silver metallic luster pigment prepared by coating the surface of thin section aluminum oxide particles with titanium oxide [mfd. by Merck Japan, trade name: Xirallic T50-10 Crystal Silver, average particle diameter 10 to 30 μm] and an acrylic ester resin was arranged thereon, and then a topcoat layer 6 having a thickness of about 40 μm consisting of 4 parts of a benzotriazole ultraviolet ray absorber and 100 parts of an acrylic ester resin was arranged on the upper layer thereof, thereby obtaining a metallic luster tone thermochromic laminate member.

At 15° C. or less, the above laminate member visualizes a silver metallic luster color having glittering high brightness, because the reversibly thermochromic layer develops color and thereby reflects light as a part of incident light and absorbs transmitted light of other wavelengths. Also, since the reversibly thermochromic layer changes color at 32° C. or more, the metallic luster color having high brightness is not visualized but a distinct fluorescent orange color due to the reversibly thermochromic layer is visualized.

COMPARATIVE EXAMPLE 1

A metallic luster tone thermochromic laminate member was obtained in the same manner as in Inventive Example 2, except that a gold metallic luster pigment prepared by coating the surface of natural mica with titanium oxide [mfd. by Merck, trade name: Iriodin 205, average particle diameter 10 to 60 μm] was used instead of the gold metallic luster pigment of Inventive Example 2.

In the above laminate member, a gold metallic luster color is visualized at 15° C. or less due to color development of the reversibly thermochromic layer and the color becomes white at 32° C. or more due to decoloration of the reversibly thermochromic layer, similar to the case of Inventive Example 2, but its metallic luster color brightness is low in comparison with Inventive Example 2 and it is poor in transparency. In addition, the white color visualized under the decolored state of the reversibly thermochromic layer is not clear, too.

COMPARATIVE EXAMPLE 2

A metallic luster tone thermochromic laminate member was obtained in the same manner as in Inventive Example 3, except that a blue metallic luster pigment prepared by coating the surface of natural mica with titanium oxide [mfd. by Merck, trade name: Iriodin 225, average particle diameter 10 to 60 μm] was used instead of the gold metallic luster pigment of Inventive Example 3.

In the above laminate member, a blue metallic luster color is visualized at 15° C. or less due to color development of the reversibly thermochromic layer and the color becomes white at 32° C. or more due to decoloration of the reversibly thermochromic layer, similar to the case of Inventive Example 3, but its metallic luster color brightness is low in comparison with Inventive Example 3 and it is poor in transparency. In addition, the white color visualized under the decolored state of the reversibly thermochromic layer is not clear, too.

COMPARATIVE EXAMPLE 3

A metallic luster tone thermochromic laminate member was obtained in the same manner as in Inventive Example 7, except that a silver metallic luster pigment prepared by coating the surface of natural mica with titanium oxide [mfd. by Merck, trade name: Iriodin 100, average particle diameter 10 to 60 μm] was used instead of the silver metallic luster pigment of Inventive Example 7.

In the above laminate member, a silver metallic luster color is visualized at 15° C. or less due to color development of the reversibly thermochromic layer and the color becomes white at 32° C. or more due to decoloration of the reversibly thermochromic layer, similar to the case of Inventive Example 7, but its metallic luster color brightness is low in comparison with Inventive Example 7 and it is poor in transparency. In addition, the white color visualized under the decolored state of the reversibly thermochromic layer is not clear, too.

COMPARATIVE EXAMPLE 4

A metallic luster tone thermochromic laminate member was obtained in the same manner as in Inventive Example 8, except that a gold metallic luster pigment prepared by coating the surface of natural mica with titanium oxide [mfd. by Merck, trade name: Iriodin 205, average particle diameter 10 to 60 μm] was used instead of the gold metallic luster pigment of Inventive Example 8.

In the above laminate member, a gold metallic luster color is visualized at 15° C. or less due to color development of the reversibly thermochromic layer and the color becomes white at 32° C. or more due to decoloration of the reversibly thermochromic layer, similar to the case of Inventive Example 8, but its metallic luster color brightness is low in comparison with Inventive Example 8 and it is poor in transparency. In addition, the white color visualized under the decolored state of the reversibly thermochromic layer is not clear, too.

The invention can provide a metallic luster tone thermochromic laminate member which can be used in versatile applications and developments, because it can visualize gold, silver, other various metallic colors and the like metallic luster colors having glittering high brightness and changes in color by the reversible thermochromic layer and it can also visualize distinct changes in color because the color changes of the reversible thermochromic layer are not spoiled by the metallic luster layer so that it can provide conspicuity, specificity, decorativeness, novelty and the like.

While the invention has been described in detail and with reference to specific embodiments thereof, it will be apparent to one skilled in the art that various changes and modifications can be made therein without departing from the scope thereof.

This application is based on Japanese patent applications No. 2001-199451 filed Jun. 29, 2001 and No. 2001-211496 filed Jul. 12, 2001, the entire contents thereof being hereby incorporated by reference.

What is claimed is:

1. A metallic luster tone thermochromic laminate member, which comprises a laminate of (1) a metallic luster layer comprising a metallic luster pigment comprising a synthetic mica having been coated with a metal oxide at the surface thereof, and (2) a reversible thermochromic layer comprising a thermochromic composition comprising an electron-donating color-forming organic compound, an electron-accepting compound and an organic compound medium in which color reactions of both compounds take place reversibly.

2. The metallic luster tone thermochromic laminate member according to claim 1, wherein the surface of the aforementioned synthetic mica is coated with a metal oxide comprising titanium oxide as the main component.

3. The metallic luster tone thermochromic laminate member according to claim 1, wherein the aforementioned metallic luster pigment has an average thickness of from 0.1 to 5 μm and an average particle diameter of from 2 to 1,000 μm.

4. A metallic luster tone thermochromic laminate member, which comprises (1) a laminate of a metallic luster layer comprising a metallic luster pigment comprising a thin section aluminum oxide having been coated with a metal oxide at the surface thereof, and (2) a reversible thermochromic layer comprising a thermochromic composition comprising an electron-donating color-forming organic compound, an electron-accepting compound and an organic compound medium in which color reactions of both compounds take place reversibly.

5. The metallic luster tone thermochromic laminate member according to claim 4, wherein the surface of the aforementioned thin section aluminum oxide is coated with a metal oxide comprising titanium oxide as the main component.

6. The metallic luster tone thermochromic laminate member according to claim 4, wherein the aforementioned metallic luster pigment has an average thickness of from 0.1 to 5 $\mu$m and an average particle diameter of from 2 to 200 $\mu$m.

* * * * *